United States Patent [19]

Bussard

[11] 3,984,948

[45] Oct. 12, 1976

[54] COLLAPSIBLE BUILDING STRUCTURE

[75] Inventor: Willis A. Bussard, San Francisco, Calif.

[73] Assignee: Altair Industries, Inc., San Francisco, Calif.

[22] Filed: Mar. 9, 1973

[21] Appl. No.: 339,727

[52] U.S. Cl. ..... 52/69; 52/64; 52/79

[51] Int. Cl.[2] ..... E04B 1/344

[58] Field of Search ..... 52/70, 71, 69, 68, 64, 52/79

[56] References Cited

UNITED STATES PATENTS

| | | | |
|---|---|---|---|
| 1,861,548 | 6/1932 | Peck | 52/69 X |
| 1,946,164 | 2/1934 | Handashelt | 52/64 X |
| 2,015,176 | 9/1935 | Ebenback | 52/69 |
| 2,523,205 | 9/1950 | Fletcher | 52/69 |
| 2,786,710 | 3/1957 | Chapman | 52/69 X |
| 2,793,067 | 5/1957 | Couse | 52/68 X |
| 3,070,850 | 1/1963 | Mc Clure | 52/69 |
| 3,394,961 | 7/1968 | Matte | 52/64 X |
| 3,417,518 | 12/1968 | Jaffe | 52/69 X |
| 3,420,567 | 1/1969 | Christensen | 52/64 X |

FOREIGN PATENTS OR APPLICATIONS

| | | | |
|---|---|---|---|
| 559,004 | 3/1957 | Italy | 52/68 |

*Primary Examiner*—Price C. Faw, Jr.
*Assistant Examiner*—Leslie Braun
*Attorney, Agent, or Firm*—Phillips, Moore, Weissenberger, Lempio & Strabala

[57] ABSTRACT

A structure which may be shipped as a container has a rectangular floor base portion and two panel assemblies associated therewith. Each panel assembly is made up of a side wall panel pivotally connected to an edge of the base portion by means of a continuous hinge, and another side wall panel fixed thereto and extending inwardly thereof. As a container, these two panel assemblies are positioned with their hinged panels generally perpendicular to the base portion, and with the other panels thereof generally parallel to the base portion. Container end panel members may be fixed to both ends of the structure so that a closed container is defined. Upon removal of the container end panel members, the panel assemblies may be pivoted to expanded, outward positions, and end panels and roof panels, carried in the closed, container-like structure, may be fitted thereto to fabricate and define a building structure. Various other parts and equipment necessary to the erection and completion of the building structure may be included, stored and carried in the closed, container-like structure, to be used upon the opening of the container. In addition, or alternatively, material not associated with the building structure may be carried in the closed, container-like structure.

14 Claims, 21 Drawing Figures

FIG. 4.
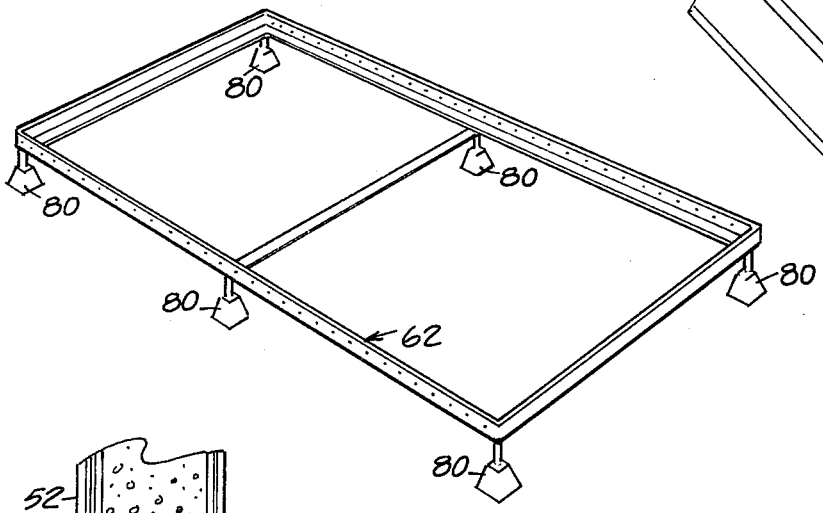
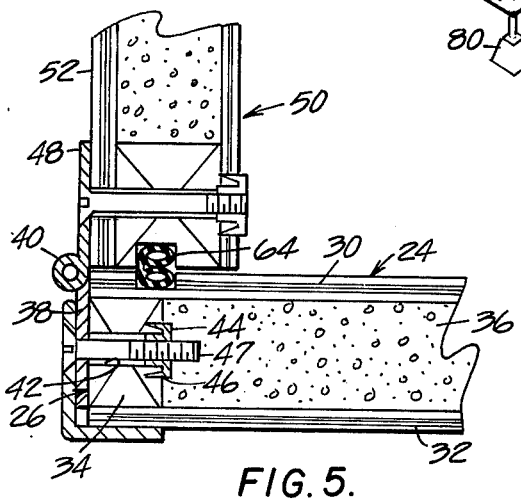
FIG. 5.
FIG. 8.
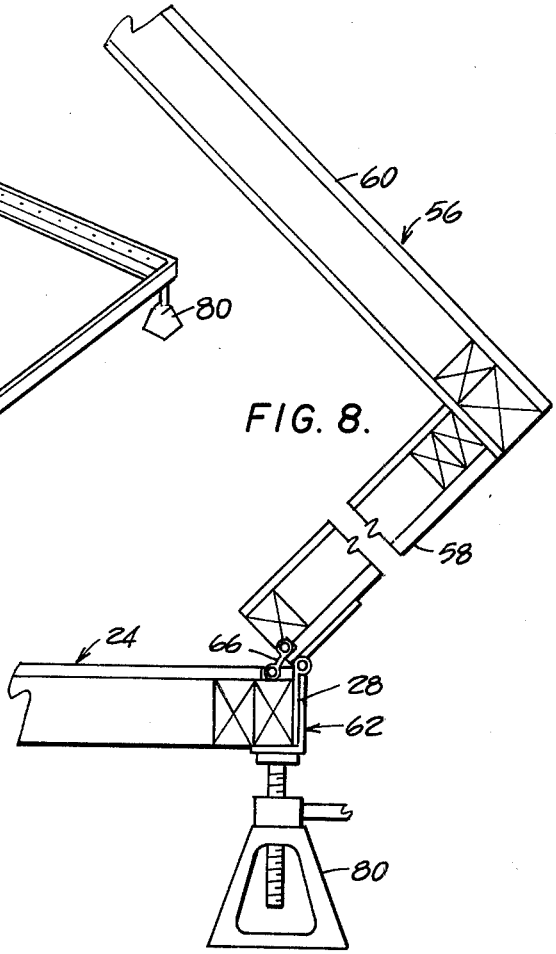
FIG. 6.
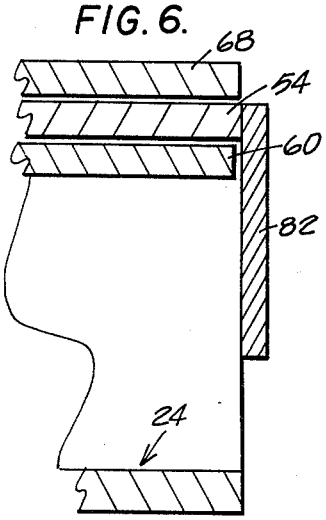
FIG. 7.
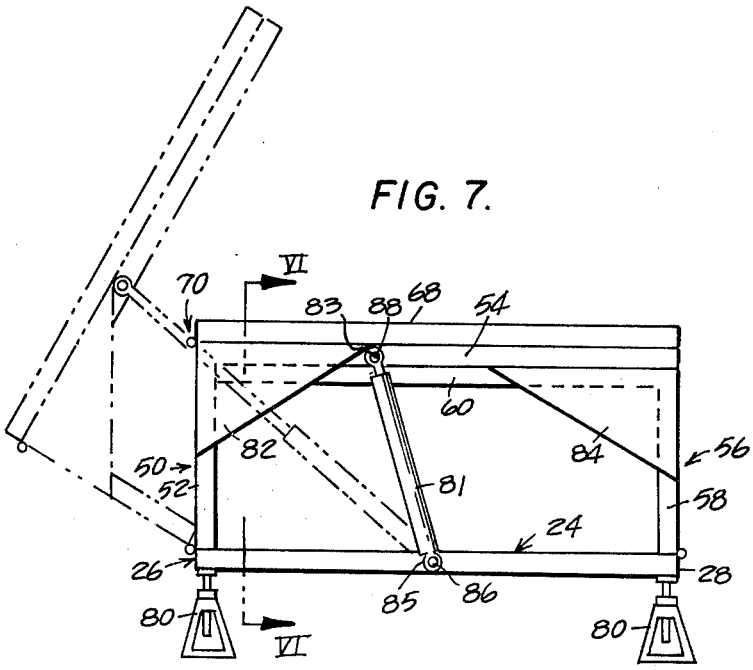

FIG. 12.
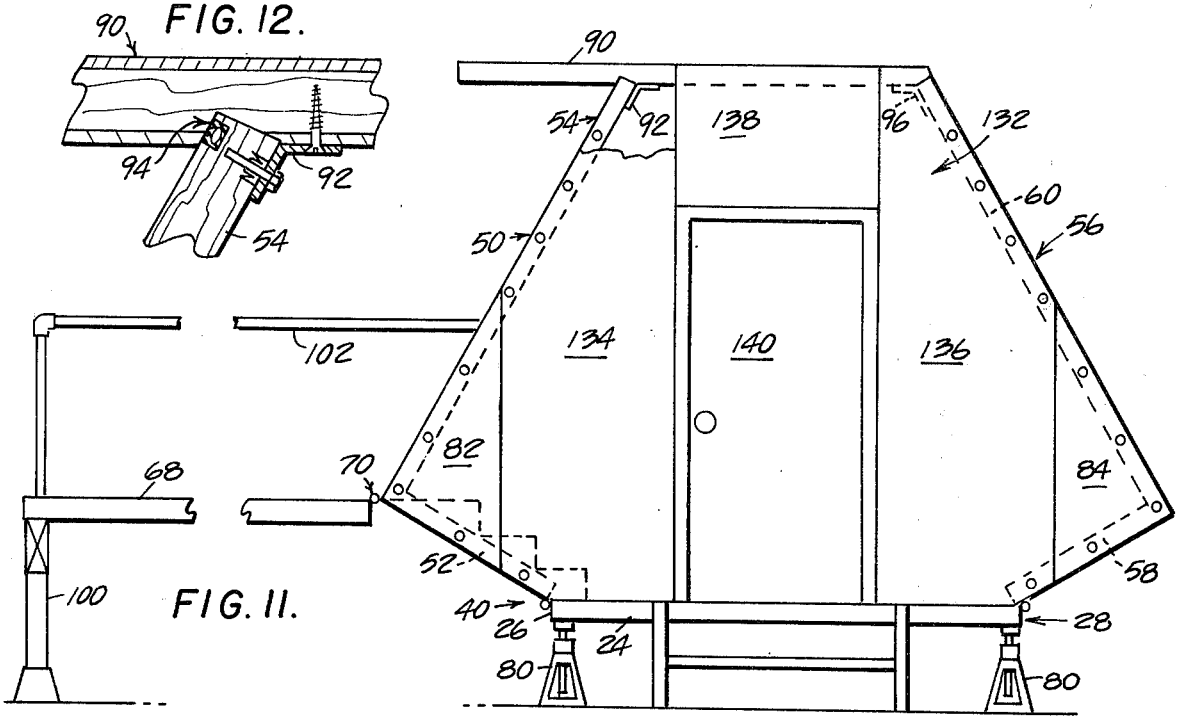
FIG. 11.
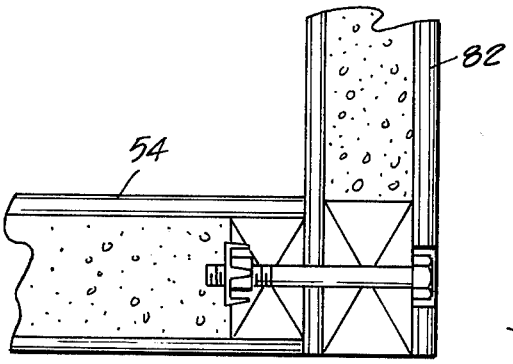
FIG. 10.
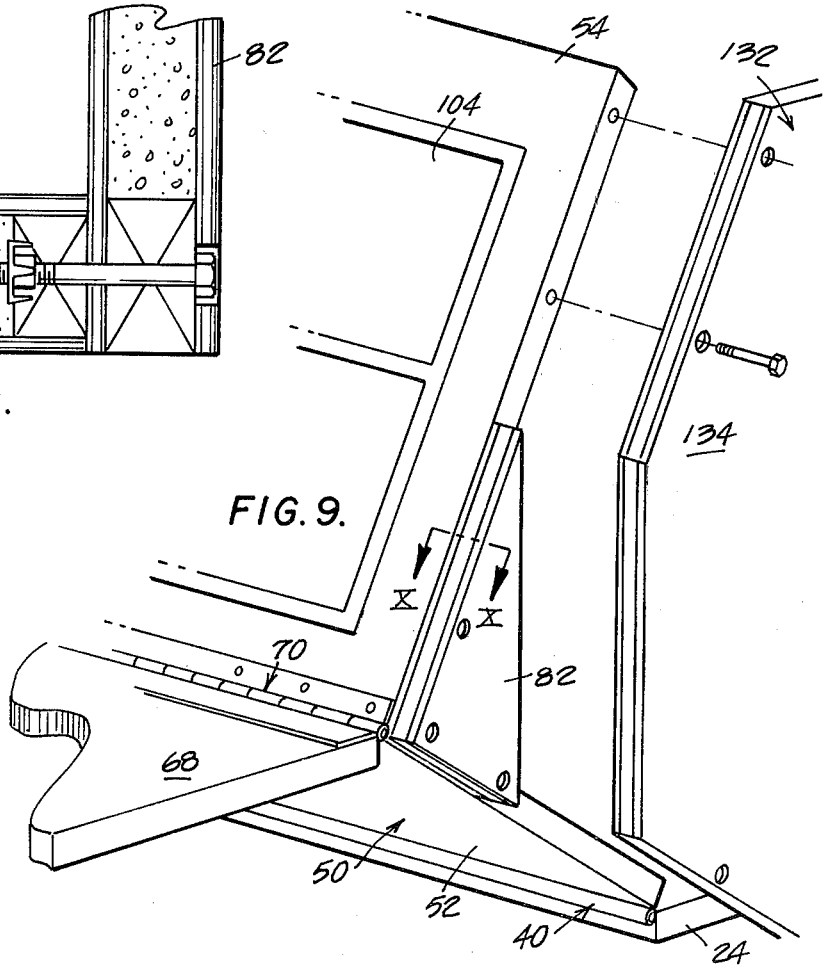
FIG. 9.

FIG. 16.
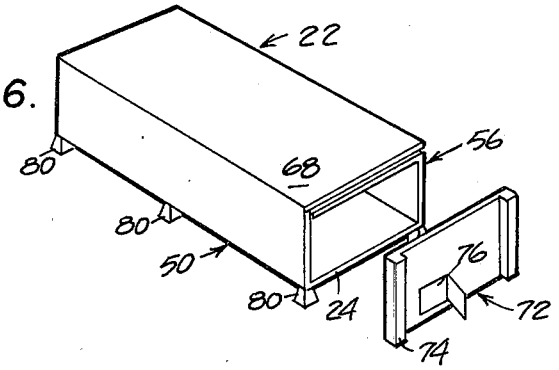
FIG. 17.
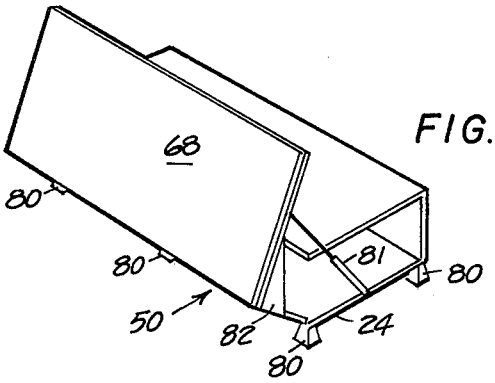
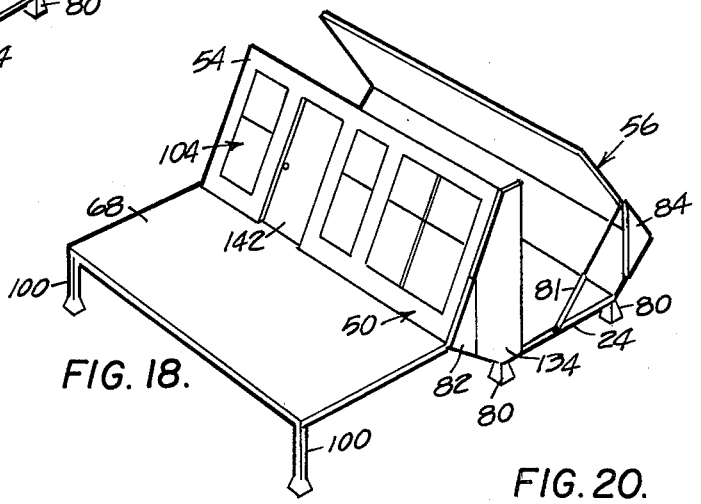
FIG. 18.
FIG. 19.
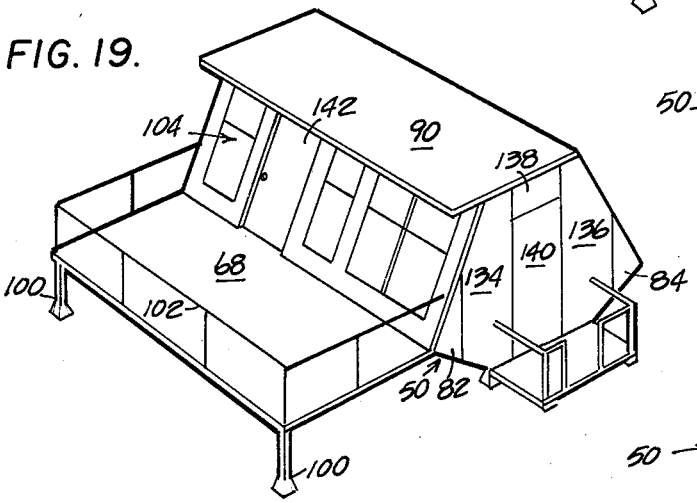
FIG. 20.
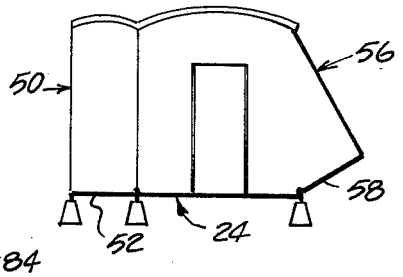
FIG. 21.
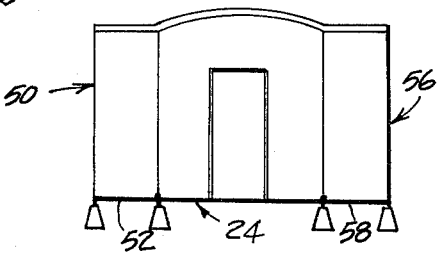

COLLAPSIBLE BUILDING STRUCTURE

BACKGROUND OF THE INVENTION

This invention relates to building structure systems, and more particularly, to a building structure system which may be shipped as a container, and then be erected as a dwelling or the like, with those parts and equipment necessary to completion of the dwelling being originally housed within the shipped container.

In containerized shipping, it is sometimes the case that the containers, after arrival at a rail head, port, etc., and unloading thereof, must be shipped back empty (or not shipped back at all), resulting in a waste of shipping space and/or resultant loss of economy. It would clearly be advantageous, in such cases, if the container, instead of having to be shipped back, could be simply and easily adapted for advantageous use at the point of disembarkation, as, for example, a dwelling, hospital, school, office, or the like. Conversely, it would be advantageous to design a dwelling or the like so that it may be shipped by rail, truck, ship, etc., in the form of a standardized container, and then be easily adapted, at the point of disembarkation, and by means completely housed within the container, to a final form of building which is designed as a dwelling which is attractive and convenient for use.

With such advantages, a building could be located at a remote site which otherwise would be uninhabitable by any practical means. This would be so because the building could easily be put back into container form for easy and convenient shipping from the site. Such a system could be used on leased lands and moved upon expiration of the lease, to upgrade use of land that would otherwise remain at a low level of use because it is slated for some permanent building or other use in the future. Such a system could also be used to permit living on land that for ecological reasons would not support a permanent building with a normal foundation, and for temporary use for housing where there is a sudden surge of housing need, such as in the event of a disaster, movement of migrant farm workers, construction projects, or large sporting event. Overall, such an invention would enable man to use land for temporary or permanent use which would normally not be available due to ecological, legal, or economic reasons, and would make it possible to upgrade the standard of housing where temporary needs exist.

SUMMARY OF THE INVENTION

It is an object of this invention to provide a dwelling structure which may, with minimal work thereon, be made into a container-like structure and shipped as a container.

It is a further object of this invention to provide a container-like structure which, while fulfilling the above object, contains within itself when shipped all that is necessary to convert such container to a finalized dwelling structure or the like.

It is a still further object of this invention to provide a container-like structure which, while fulfilling the above objects, is simple in design, and allows for simple conversion to such on-site dwelling structure or the like.

Broadly stated, the invention comprises a building structure comprising a substantially flat base portion having first and second generally parallel edges. Further included is a first panel assembly comprising a first panel hingedly fixed to the first edge of the base portion and normally positioned substantially perpendicular to the base portion, and a second panel fixed to the first panel and generally perpendicular to the first panel. Further included is a second panel assembly comprising a third panel hingedly fixed to the second edge of the base portion and normally positioned substantially perpendicular to the base portion, and a fourth panel fixed to the third panel and generally perpendicular to the third panel. The second and fourth panels are disposed toward each other and have portions in lapping relation when the first and third panels are so normally disposed. The first panel assembly and second panel assembly are, through such hinged fixing, pivotable outwardly of each other to outward positions. Further included are means for maintaining the first and second panel assemblies in said outward positions.

BRIEF DESCRIPTION OF THE DRAWINGS

These and other objects of the invention will become apparent from a study of the following specifications and drawings, in which:

FIG. 4 is an overall perspective view of the metal frame of the structure;

FIG. 5 is a sectional view taken along the line V—V of FIG. 3, showing the attachment of a panel assembly to the base portion of the container;

FIG. 6 is a sectional view taken along the line VI—VI of FIG. 7;

FIG. 7 is an end view of the structure, showing one panel assembly being moved to its outward position;

FIG. 8 is a sectional view showing the attachment of a panel assembly to the base portion after it has been moved to its outward position;

FIG. 9 is a perspective view of a corner of the structure, showing the addition of end panels thereto;

FIG. 10 is a sectionnal view taken along the line X—X of FIG. 9;

FIG. 11 is an end elevation of the structure, showing the end panels in place;

FIG. 12 is an enlarged sectional view showing the jointing of one panel assembly with the roof portion of the structure;

FIGS. 16–19 are schematic views showing the conversion of the container to a dwelling structure; and FIGS. 20–21 are end views showing two other embodiments of completed dwelling structure.

DESCRIPTION OF THE PREFERRED EMBODIMENT

Figure 1:
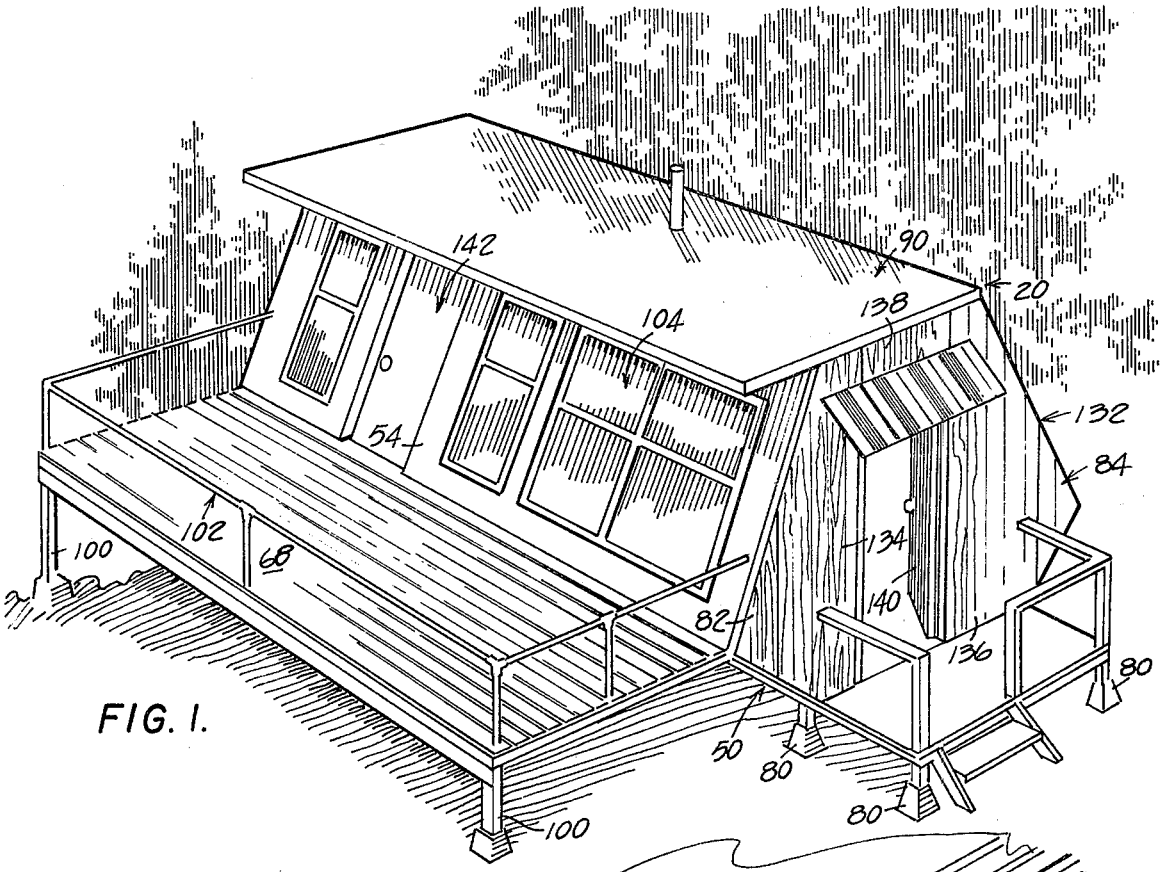
FIG. 1 is a perspective view of the preferred embodiment of the completed dwelling structure.
Figure 2:
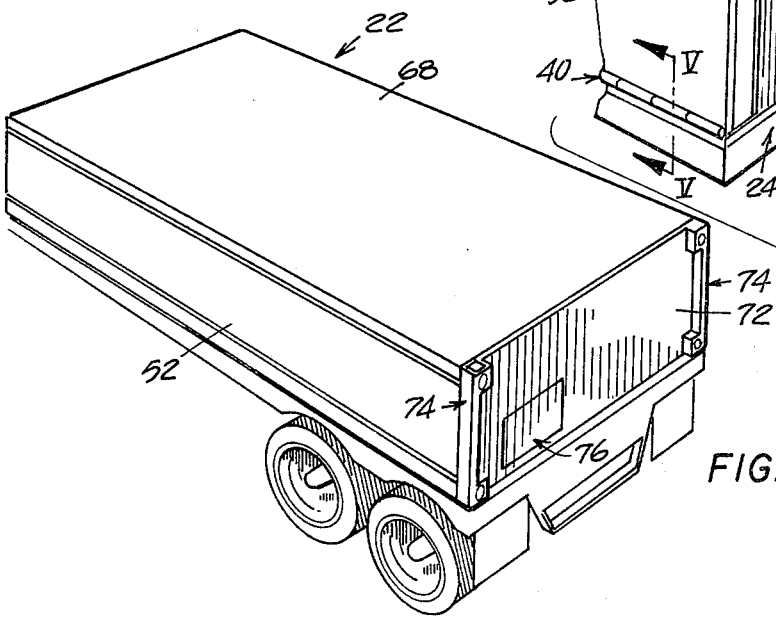
FIG. 2 is a perspective view of the dwelling structure of FIG. 1 in container form for shipping thereof.

Shown generally in FIG. 1 is the preferred embodiment of completed dwelling structure 20 which has been completed at the site after having been shipped thereto in container form 22 as shown in FIG. 2. With reference to FIGS. 2–7, the container 22 includes a substantially flat rectangular base or floor portion 24 having first and second generally parallel edges 26, 28 and made up, as are all the other panels of the structure, or a pair of flat, parallel sheets 30, 32, and continuous rail members 34 about the periphery thereof. Plastic foam material 36 fills the inside of the base portion 24, between sheets 30, 32. Additional reinforcing rail members (not shown) may be included between sheets 30, 32. One leaf 38 of a continuous hinge 40 is fixed to the first edge 26 of the base portion 24 by means which will now be described in detail with reference to FIG. 5, such means of attachment being used throughout the assembly.

In the assembly of the base portion 24, rail members 34 have bores 42 drilled therethrough. Into the rear of each bore 42 is inserted a nut 44, such nut having a toothed portion 46 which must be forced into the associated rail member 34. Such nut 44 is then held in place and is fixed from turning. The sheets 30, 32 are then fixed to the rail members 34, and the space between the sheets 30, 32 is now filled with foam 36 (after applying tape over the inner portions of the nuts 44, to keep foam 36 from flowing therethrough and outwardly of the base portion 24). The leaf 38 of hinge 40 has apertures therethrough which register with the bores 42 in the rail member 34, and is then positioned so that bolts 47 may be applied therethrough to nuts 44. In this way, leaf 38 is fixed to edge 26.

Leaf 48 of hinge 40 has bolted thereto a panel assembly 50 (FIGS. 5 and 7). Panel assembly 50 is made up of panel 52, which is that panel directly fixed to leaf 48 of hinge 40, and a panel 54 fixed to the top end of the panel 52 and generally perpendicular thereto.

A second panel assembly 56 is fixed to the second edge 28 of the base portion 24 in the same manner as the first panel assembly 50. Such panel assembly 56 is made up of panel 58 hingedly fixed to the edge 28 of the base portion 24, and panel 60 fixed to panel 56 and generally perpendicular thereto.

In what will be called the "normal positions" of the panel assemblies 50, 56 and panels 52, 58, corresponding to FIG. 5, and shown in full in FIG. 7, the panel 52 is substantially perpendicular to the base portion 24, and the panel 58 is also substantially perpendicular to the base portion 24. Also, when normally positioned, the panels 54, 60 are disposed toward each other, and the panel 54 completely and fully overlaps the panel 60.

The base portion 24 includes a rigid frame 62 (FIG. 4) to which the hinges interconnecting the panel assemblies 50, 56 and base portion 24 are fixed by means of bolts 47 passing through apertures in the base portion 24 or by welding. Seal means 64, 66 are included between panel 52 and base portion 24, and panel 58 and base portion 24 respectively, as shown (FIGS. 5 and 8). Yet another panel 68 is hingedly fixed to panel assembly 50 along an edge of panel 54 by means of a continuous hinge 70. Such panel 68 is pivotable to lie along and on top of the panel 54 and is sized to completely and fully overlap panel 54.

Disposed at one end of the structure 22 is an end member 72 which is removably secured to the base portion 24, panel 52, panel 56, and panels 68 and 54, with the panel assemblies 50, 56 in their normal positions and the panel 68 overlapping panel 54. Such end member 72 is secured by the nut and bolt system of FIG. 5, and is secured relative to panels 54, 60. A like end member (not shown) is removably secured to the base portion 24, panels 52, 56 and 68, and 54 at the end opposite end member 72. The base portion 24, panels 52, 58, 68, and end members (one shown at 72) define the exterior of the closed container 22. The end members include removable pockets 74 as a part thereof so that such structure may be normally transported as a container 22 as shown in FIG. 2.

Figure 3:
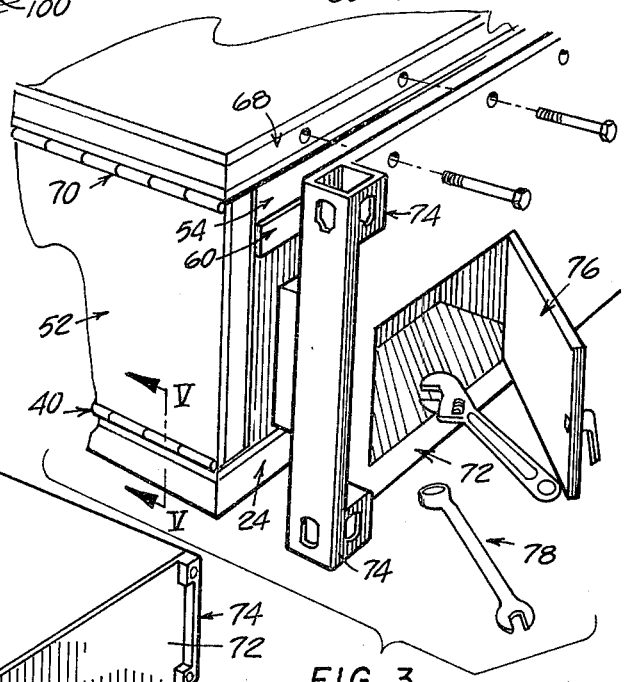
FIG. 3 is a perspective view of the end of the container of FIG. 2, showing removal of an end member of the container.

As shown in FIG. 3, end member 72 defines a door 76 which is designed to be opened with a key. Opening of such door 76 allows access to tools 78 and leveling jacks 80 which are then disposed about and under the frame 62 (FIG. 4). and on the ground for supporting and leveling the base portion 24 above the ground. Tools 78 may then be used to remove end member 72 and the other end member. Removal of these end members allows access to the inside of the container 22, which contains a pair of construction jacks (one shown at 81), and end gusset panels 82 and 84 (FIG. 7). End gusset panel 82 may then be fixed to panel 52 and panel 54 so as to interconnect them, by the nut and bolt system previously described (See FIG. 5). End gusset panel 84 may be fixed to and interconnect panel 58 and panel 60 in a similar manner. A similar pair of end gusset panels are associated with the structure at the other end thereof in a similar manner. Construction jack 81 is set in place, and has one end 85 pivotally connected to the base portion 24 midway between edges 26 and 28 (by means of a pin 86 inserted into an aperture in the base portion 24), and the other end 83 pivotally connected to the panel 54, by means of a similar pin 88 in an aperture in panel 54, so as to interconnect the base portion 24 and panel 54. Another similar construction jack, not shown, is mounted to the other end of the structure in the same way if required. Upon raising of these construction jacks, panel assembly 50 may be moved to an outward position, as shown in FIG. 7. Through the use of such construction jacks interconnecting the base portion 24 and panel assembly 56, such panel assembly 56 may be pivoted to an outward position also (FIG. 8). As shown in FIGS. 7 and 8, and also clearly shown in FIGS. 1 and 11, with the panel assemblies 50, 56 in such outward positions, panels 52, 58 extend upwardly and outwardly from the base portion 24 and outwardly of each other. With such panel assemblies in such outward positions, panels 54, 60 extend upwardly and inwardly from the panels 52, 58 respectively, and inwardly of each other.

As an alternative to the construction jacks, a turnbuckle assembly interconnecting panel assemblies 50, 56 on each one or both ends of the structure can be used. In such case, the turnbuckle or turnbuckles can provide outward movement of the panel assemblies 50, 56, meanwhile also providing positive inward holding of the panel assemblies 50, 56.

Figure 13:
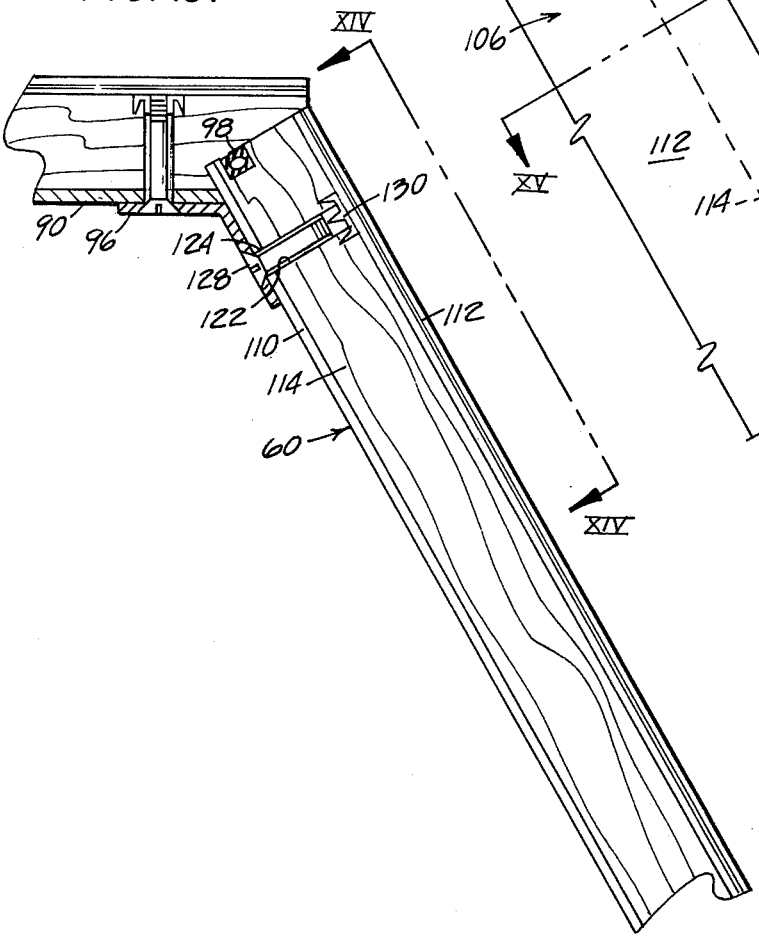
FIG. 13 is an enlarged sectional view showing the jointing of the other panel assembly with the roof portion of the structure.

Roof panels 90, also contained within container 22, may be fixed to the upper edges of the panel assemblies 50, 56 in their outward positions, as shown in FIG. 11, and in detail in FIGS. 12 and 13. In the case of the joint of a roof panel 90 with the panel 54, a bracket 92 is bolted to the panel 54 and secured by means of screws to the roof panel 90, and a seal gasket 94 is disposed between panel 54 and panel 90 as shown in FIG. 12. As shown in FIG. 13, panel 60 is fixed to a roof panel 90 by means of a bracket 96 which is bolted to both the panel 60 and roof panel 90, with a similar seal gasket 98 being included. Such roof panels 90 interconnect the panel assemblies 50, 56 in their outward positions.

The panel 68 may be pivoted away from its overlapping relation with the panel 54 to a horizontal position extending outwardly thereof (FIG. 11). Support means 100 (which may include leveling jacks), contained within the container 22 may then be disposed on the ground for supporting panel 68 in its outwardly extending position (FIG. 11). Railings 102, also contained in the container 22, may then be applied to the panel 68 as shown.

The panel 54 in this embodiment defines windows 104 which are positioned to be covered by the panel 68 when that panel 68 overlaps panel 54, and exposed, as shown in FIG. 9, when panel 68 is pivoted to its outward position.

Figure 15:
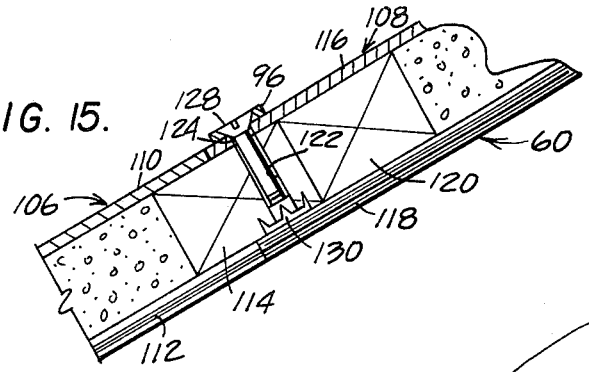
FIG. 15 is a sectional view taken along the line XV—XV of FIG. 14.
Figure 14:
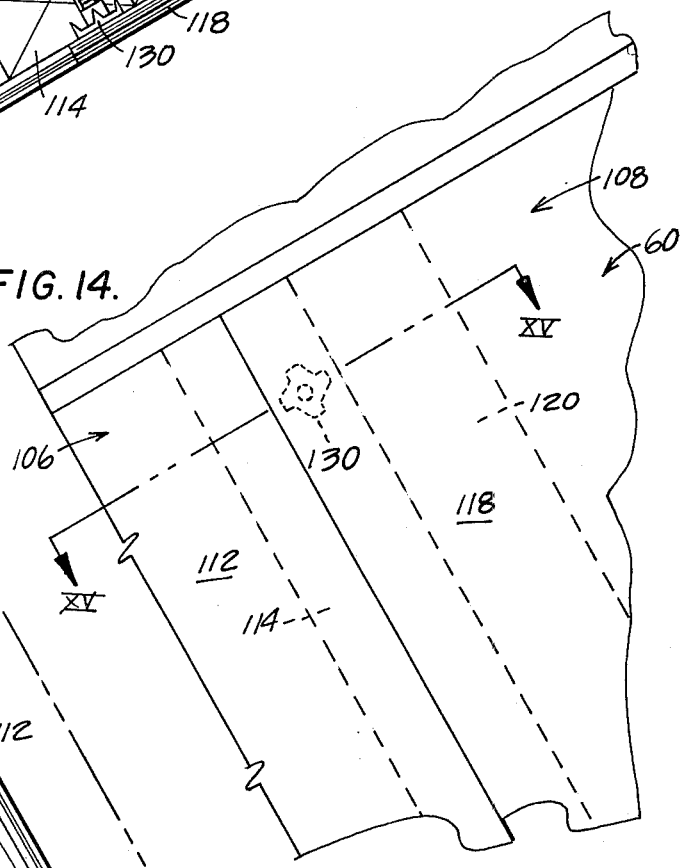
FIG. 14 is a view taken along the line XIV—XIV of FIG. 13.

A detail of panel 60, which may be taken as typical of any of the panels in the structure, is shown in FIGS. 14 and 15. Panel 60 is actually made up of a plurality of subpanels, for example 106, 108 as shown. Subpanel 106 is made up of a pair of spaced sheets 110, 112 and rail member 114, and subpanel 108 is also made up of a pair of spaced sheets 116, 118 and rail member 120, as previously described. However, rail member 120 is recessed between spaced sheets 116, 118, and rail member 114 extends from between spaced sheets 110, 112 and between spaced sheets 116, 118. The positioning is such that a plurality of bores in rail member 114 (one shown at 122) register with bores in sheet 116 (one shown at 124), so that a bolt 128 may be disposed therethrough and into a nut 130 fixed to rail member 114, to hold subpanels 106, 108 together. The result is a "tongue and groove" system secured together with bolts.

Additional end panel means 132 are also included within the container 22, and may be mounted to the base portion 24, panel assemblies 50, 56 and roof panels 90, at one end of the structure (FIGS. 9 and 11). Similar end panel means are also included to be mounted at the other end of the structure, to close the structure. The additional end panel means 132 are actually made up of end panels 134, 136 and 138, and door panel 140, which, through such door panel 140, allow access to within the closed building structure.

In the actual transportion amd conversion of the container 22, it is of course shipped as shown in FIG. 16, and contains all the parts necessary to achieve the final design shown in FIG. 1. Initially, at the point of disembarkation, the door 76 is opened by means of a key provided, the tools 78 and leveling jacks 80 are removed and installed, and the end members (one shown at 72) are removed. The end members may then be used as foundation means under the base portion 24 if, for example, the ground at the site is soft.

Removal of the end member 72 allows access to end panel gussets 82, 84, which are then fixed in place as shown, and similar end panels for the other end of the structure, which are also then fixed in place. These end panels strengthen the panel assemblies 50, 56 while they are being jacked into the outward positions. Removal of the end member 72 allows access to the construction jacks (one shown at 81). Initially, jack 81 is installed as shown, and the other like jack is installed at the other end of the structure. Through jacking on both ends of the structure, panel assembly 50 is pivoted outwardly (FIG. 17). End panel 134 is then installed to hold panel assembly 50 in such outward position.

Jack 81 (and the corresponding construction jack on the other end of the structure) are then switched to the position shown in FIG. 18 to pivot panel assembly 56 outwardly. End panel 136 is then installed to hold panel assembly 56 in such outward position. Deck panel 68 may be pivoted away from panel 54, uncovering the windows 104, and into the position shown in FIG. 18, acting as a deck. Access may be provided to the deck from inside the structure by a door 142 defined by the panel 54. Support means 100 may then be installed to support the deck 68, and the railing 102 may be installed. The roof panels 90 may then be installed, and end panel 138 and door panel 140 may be installed as shown (FIG. 19). The similar end panel means provided may be installed at the far end of the building structure to provide a closed building structure 20, as shown in FIG. 1.

It should be noted that, in the shipping of the container 22, windows 104 are positioned so as to be protected by the overlapping deck panel 68. Thus, damage to such windows 104 is guarded against. In addition, with the building structure 20 completed, the panel 68 could, after removal of railings 102, be pivoted back into overlapping relation with panel 54 and the windows 104 therein, to for example winterize the structure 20 if desired, burglarize-proof the structure or allow the building structure 20 to be moved by helicopter to another site if desired.

The particular method of joining panels shown in FIGS. 14–15 results in the advantage that the overall length of the structure 20 may be varied relatively easily, by the addition or removal of panels, if desired. This may be necessary to comply with building codes which call for a minimum of square footage for a dwelling, etc., and/or comply with appropriate container codes.

The plastic foam provided throughout the paneling insures proper insulation of the building structure 20 when used as a dwelling or the like.

The outer surface of the container 22 could be of a variety of materials, for example, fiberglass, so as to provide proper protection.

The particular shape of the final building structure 20 (FIG. 1) provides a number of advantages. For example, the corners defined by panel 52 and 54, and panel 58 and panel 60, could be used for placement of electrical conduits, keeping them out of the way, yet conveniently reachable if necessary. As another example, water tanks could be provided outside and fixed to the building structure 20 under the panels 52, 58. Such water tanks would utilize space that would otherwise be wasted, meanwhile adding stability (through the weight and positioning thereof) to the building structure 20.

It should be understood that a variety of parts may be contained within the container 22, all of which may be used in the completion of the building structure 20 (for example, beds, toilet facilities, utensils, etc.). On the other hand, the container 22 could contain a small or large portion of goods to be shipped which are not related to the building structure 20 itself. In such case, after removal of the goods, the remaining parts provided, in combination with the container 22, could be converted to a simple building.

It will also be understood that there can be many variations in the overall design and detail design of the structure, without departing from the spirit of the invention. As an example of such variation, building structures could be put end-to-end, with a single entrance thereto at the end of the completed structure, or with individual entrances to each building structure. As another example, building structures could be disposed in parallel relation, with a hallway running therebetween.

FIGS. 20 and 21 show variations of the final structure. In FIG. 20, panel assembly 56 has been pivoted outward to a position similar to that in the preferred embodiment. However, panel assembly 50 has been pivoted outward until panel 52 is parallel to base portion 24. And in the embodiment of FIG. 21, both panels 52 and 58 have been disposed parallel to the base portion. These are examples of variations which can occur without departing from the spirit of the invention.

What is claimed is:

1. A building structure comprising:

a substantially flat base portion having first and second generally parallel edges;

a first panel assembly comprising a first panel associated with the first edge of the base portion and normally positioned substantially perpendicular to the base portion, and a second panel fixed to the first panel and generally perpendicular to the first panel;

a second panel assembly comprising a third panel associated with the second edge of the base portion and normally positioned substantially perpendicular to the base portion, and a fourth panel fixed to the third panel and generally perpendicular to the third panel;

the second and fourth panels disposed toward each other and having portions in lapping relation when the first and third panels are so normally positioned;

the first panel assembly and second panel assembly being movable outwardly of each other to outward positions;

means for maintaining the first and second panel assemblies in such outward positions;

wherein the first panel is hingedly fixed to the first edge of the base portion, wherein the third panel is hingedly fixed to the second edge of the base portion, and wherein the first and second panel assemblies are pivotable outwardly of each other through such hinged fixing;

wherein with the first and third panels normally positioned, a second panel portion overlaps a fourth panel portion, and further comprising a fifth panel hingedly fixed to the first panel assembly to be pivotable to overlap the second panel with the first and third panels normally positioned, and pivotable away from said second panel to a position extending outwardly thereof with the first and second panel assemblies in said outward positions;

wherein the fifth panel is pivotable to completely and fully overlap the second panel, and the second panel completely and fully overlaps the fourth panel when the first and third panels are normally positioned; and a first end member at one end of the structure and removably secured to the base portion, first and third panels in their normal positions, and the fifth panel, with the fifth panel pivoted to overlap the second panel, and a second end member at the other end of the structure and removably secured to the base portion, first and third panels in their normal positions, and the fifth panel, with said fifth panel pivoted to overlap the second panel, whereby the building structure is closed with the first and third panels normally positioned, the removal of the first end member and second end member allowing the first and second panel assemblies to be pivoted to their outward positions.

2. The building structure of claim 1 and further comprising a first end panel within the building structure closed with the first and third panels normally positioned and which, upon said removal of the first end member, may be fixed to and interconnect the first panel and second panel, and a second end panel within the building structure closed with the first and third panels normally positioned and which, upon said removal of the first end member, may be fixed to and interconnect the third panel and fourth panel.

3. The building structure of claim 2 and further comprising a third end panel within the building structure closed with the first and third panels normally positioned and which, upon removal of the second end member, may be fixed to and interconnect the first panel and second panel, and a fourth end panel within the building structure closed with the first and third panels normally disposed and which, upon removal of the second end member, may be fixed to and interconnect the third panel and fourth panel.

4. The building structure of claim 3 and further comprising means interconnecting the first and second panel assemblies in said outward positions comprising roof panel means within the building structure closed with the first and third panels normally positioned and which may be fixed to the second and fourth panels.

5. The building structure of claim 4 and further comprising first additional end panel means within the building structure closed with the first and third panels normally positioned and which may be mounted to the first panel assembly, second panel assembly, base portion, and roof panel means with the first and second panel assemblies in said outward positions, and second additional panel means within the building structure closed with the first and third panels normally positioned and which may be mounted to the first panel assembly, second panel assembly, base portion, and roof means with the first and second panel assemblies in said outward positions, whereby the building structure may be closed with the first and second panel assemblies in their outward positions.

6. The building structure of claim 5 wherein the second panel defines window means positioned to be covered by the fifth panel when said fifth panel overlaps said second panel.

7. The building structure of claim 6 and further comprising access means defined by the first additional end panel means for providing access within the building structure closed with the first and second panel assemblies in their outward positions.

8. A building structure comprising:

a substantially flat base portion having first and second generally parallel edges;

a first panel assembly comprising a first panel hingedly fixed to the first edge of the base portion and normally positioned substantially perpendicular to the base portion, and a second panel fixed to the first panel and generally perpendicular to the first panel;

a second panel assembly comprising a third panel hingedly fixed to the second edge of the base portion and normally positioned substantially perpendicular to the base portion, and a fourth panel fixed to the third panel and generally perpendicular to the third panel;

the second and fourth panels disposed toward each other and having portions in lapping relation when the first and third panels are so normally positioned;

a first end member at one end of the structure and removably secured to the base portion, first and third panels in their normal positions, and relative to the third and fourth panels, and a second end member at the other end of the structure and removably secured to the base portion, first and third panels in their normal positions, and relative to the third and fourth panels, whereby the building structure is closed with the first and third panels normally positioned, the removal of the first and second end members allowing the first and second panel assemblies to be pivoted, through such hinged fixing to outward positions;

first jack means positionable to interconnect said base portion and second panels for pivoting the first panel assembly to said outward position;

second jack means positionable to interconnect said base portion and fourth panel for pivoting the second panel assembly to said outward position; and, means for maintaining the first and second panel assemblies in said outward positions.

9. The building structure of claim 8 and further comprising a first end panel within the building structure closed with the first and third panels normally positioned and which, upon removal of the first end member, may be fixed to and interconnect the first panel and second panel, and a second end panel within the building structure closed with the first and third panels normally positioned and which, upon removal of the first end member, may be fixed to and interconnect the third panel and fourth panel, and further comprising a third end panel within the building structure closed with the first and third panels normally positioned and which, upon removal of the second end member, may be fixed to and interconnect the first end panel and second end panel, and a fourth end panel within the building structure closed with the first and third panels normally positioned and which, upon removal of the second end member, may be fixed to and interconnect the third panel and fourth panel.

10. The building structure of claim 9 and further comprising means interconnecting the first and second panel assemblies in said outward positions comprising roof panels within the building structure closed with the first and third panels normally positioned and which may be fixed to the second and fourth panels with the first and second panel assemblies in their outward positions, and further comprising first additional end panel means within the building structure closed with the first and third panels normally positioned and which may be mounted to the first panel assembly, second panel assembly, base portion, and roof panel means with the first and second panel assemblies in said outward positions, and second additional end panel means within the building structure closed with the first and third panels normally positioned and which may be mounted to the first panel assembly, second panel assembly, base portion, and roof panel means with the first and second panel assemblies in said outward positions, whereby the building structure may be closed with the first and second panel assemblies in their outward positions, and further comprising access means defined by the first additional end panel means for providing access to within the building structure closed with the first and second panel assemblies in their outward positions.

11. The building structure of claim 10 and further comprising third jack means disposed on the ground for supporting and leveling the base portion above the ground.

12. The building structure of claim 11 wherein, with the first and third panels so normally positioned, a second panel portion overlaps a fourth panel portion, and further comprising a fifth panel hingedly fixed to the first panel assembly to be pivotable to overlap the second panel with the first and third panels normally positioned, and pivotable away from said second panel to a position extending outwardly thereof with the first and second panel assemblies in said outward positions, and support means on the ground for supporting said fifth panel in said outwardly extending position.

13. The building structure of claim 12 wherein the second panel defines window means positioned to be covered by the fifth panel when said fifth panel overlaps said second panel.

14. The building structure of claim 13 wherein the fifth panel is pivotable to completely and fully overlap the second panel, and the second panel completely and fully overlaps the fourth panel when the first and third panels are normally positioned.

* * * * *